US006789457B2

(12) United States Patent
Sakaki et al.

(10) Patent No.: US 6,789,457 B2
(45) Date of Patent: Sep. 14, 2004

(54) GAS PRESSURE ACTUATOR CAPABLE OF STABLY DRIVING AND CONTROLLING ITS SLIDER, AND METHOD FOR CONTROLLING THE GAS PRESSURE ACTUATOR

(75) Inventors: Kazutoshi Sakaki, Fujisawa (JP); Fuminori Makino, Yokohama (JP)

(73) Assignee: Sumitomo Heavy Industries, Tokyo (JP)

( * ) Notice: Subject to any disclaimer, the term of this patent is extended or adjusted under 35 U.S.C. 154(b) by 71 days.

(21) Appl. No.: 10/241,761

(22) Filed: Sep. 12, 2002

(65) Prior Publication Data

US 2004/0050244 A1 Mar. 18, 2004

(51) Int. Cl.[7] ..... F15B 9/03
(52) U.S. Cl. ..... 91/196; 91/363 R
(58) Field of Search ..... 91/31, 196, 358 R, 91/363 R, 361, 392, 397, 398, 365; 92/117 A

(56) References Cited

U.S. PATENT DOCUMENTS 3,757,645 A * 9/1973 Roch ..... 91/196
4,872,360 A * 10/1989 Lew et al. ..... 92/117 A
6,523,451 B1 * 2/2003 Liao et al. ..... 91/363 R

FOREIGN PATENT DOCUMENTS

JP 05321904 A * 12/1993 ..... F15B/9/09
JP 07310562 A * 11/1995 ..... F02D/1/08
JP 09196004 A * 7/1997 ..... F15B/11/04

* cited by examiner

*Primary Examiner*—Thomas E. Lazo
(74) *Attorney, Agent, or Firm*—Arent Fox PLLC

(57) ABSTRACT

A controlling and computing device performs the steps of: differentiating a slider position represented by a position detection signal fed from a position sensor, and calculating the velocity of the slider, differentiating the calculated velocity so as to calculate an acceleration: using a slider target position, the slider position, the velocity and the acceleration to calculate position instruction values to be fed to two servo amplifiers; performing a computation on the respectively calculated position instruction values, so as to compensate for a pressure change which has occurred in each of pressure chambers due to a change in the position of a pressure receiving plate in a cylinder chamber; and producing the respectively compensated position instruction values to the two servo amplifiers.

5 Claims, 2 Drawing Sheets

GAS PRESSURE ACTUATOR CAPABLE OF STABLY DRIVING AND CONTROLLING ITS SLIDER, AND METHOD FOR CONTROLLING THE GAS PRESSURE ACTUATOR

BACKGROUND OF THE INVENTION

1. Field of the Invention

The present invention relates to a gas pressure actuator, particularly to an air pressure actuator and a method for controlling the air pressure actuator.

2. Description of the Related Art

As an air pressure actuator, there has been one which was suggested by the inventors of the present invention and is shown in FIG. 1. Referring to FIG. 1, such an air pressure actuator comprises a guide shaft 14 extending in one axial direction with both ends thereof fixed on a pair of support members 18, and a slider 13 movable along the guide shaft 14. In fact, the slider 13 is a cylindrical hollow body which is so formed that it can cover up part of the guide shaft 13. In this way, a cylinder space is formed between the inner surface of the slider 13 and the outer periphery surface of the guide shaft 14. Practically, such a cylinder space is used as a pressure chamber. In more detail, the cylinder space has been divided (in its axial direction) into two pressure chambers 16A and 16B by virtue of a pressure receiving plate (partition wall) 17 fixed on the internal wall of the slider 13. Accordingly, both the pressure receiving plate 17 and the slider 13 are slidable along the guide shaft 14.

On both sides of the guide shaft 14 are provided a plurality of static pressure air bearings 12 arranged to be separated from one another at a predetermined interval in the circumferential direction. Practically, these static pressure air bearings 12 are connected with an air pressure source 10 through a regulator 11A. For this purpose, a plurality of air passages are formed in the guide shaft 14 and communicated with the static pressure air bearings 12. However, since each of the static pressure air bearings is a well-known bearing in the art, a detailed explanation as to the structure thereof will be omitted in this specification.

On both sides of the guide shaft 14 and with the two pressure chambers 16A, 16B are connected intake/exhaust systems for introducing a compressed air into the pressure chambers or for discharging the same therefrom. To ensure such an air instruction and discharge, a plurality of air passages, which are independent from the above air passages for use with the static pressure air bearings, are formed in the guide shaft 14, extending from both ends of the guide shaft to the pressure chambers 16A and 16B The intake/exhaust systems are respectively equipped with servo valves 22A and 22B so as to form a desired servo control. These servo valves 22A and 22B are all connected to the air pressure source 10 through a regulator 11B.

In this way, an air which is supplied from the air pressure source 10 and whose pressure has been properly regulated by the regulator 11A can be supplied to the static pressure air bearings 12. By virtue of the compressed air blown out of the static pressure air bearings 12, the slider 13 will float from the guide shaft 14, enabling the slider 13 to move with respect to the guide shaft 14 without touching it. For this reason, there would be no sliding resistance during the movement of the slider 13. Further, a position sensor 15 based on a linear scale or the like is used to detect the position of the slider 13, and to produce an electric signal representing the slider's position. The detected position signal fed from the position sensor 15 is then fed to a controlling and computing device 20.

The controlling and computing device 20 performs control and computation based on the inputted position information and outputs position instruction signals to servo amplifiers 21A and 21B. At this time, the instruction values to be fed to the servo amplifiers 21A and 21B are those having the same absolute values but opposite signs.

The servo valves 22A and 22B receive the supply of a compressed air which has been regulated by the regulator 11B to an appropriate pressure, while the flow rate of an air flowing through each of these valves can be changed depending on the position of a spool within each of the servo valves 22A and 22B. Air flows which have passed through the servo valves 22A and 22B are supplied to the pressure chambers 16A and 16B formed within slider 13. As a result, a pressure difference occurs between the pressure chamber 16A and the pressure chamber 16B, and such a pressure difference acts on the pressure receiving plate 17 provided on the internal wall of the slider 13, causing the slider 13 to move in one of the two directions.

Since the air pressure actuator described above can control a large amount of output with a compact structure, it has been expected to be used as an actuator for performing a positioning between any two points. However, when performing a continuous positioning, such an air pressure actuator has been found to be difficult in performing a stabilized control, because a dynamic characteristic change and the like based on the position of the pressure receiving plate are non-linear. Consequently, it is difficult to obtain an effective long stroke with respect to a mechanical stroke of the slider. This is because whenever the position of the pressure receiving plate is changed within the pressure chambers, the pressures within the pressure chambers will also change, hence bringing about an undesired influence to a stabilized control.

SUMMARY OF THE INVENTION

Accordingly, it is an object of the present invention to provide an improved gas pressure actuator based on a gas pressure actuator whose slider is driven by a gas pressure using two servo valves, which is characterized in that its dynamic characteristic change depending on the position of the slider can be compensated, so as to effect a stabilized control of the slider within the stroke thereof. Further, it is another object of the invention to provide an improved method for controlling the gas pressure actuator described above.

A control method according to the present invention can be suitably applied to a gas pressure actuator described hereunder. The gas pressure actuator includes a guide shaft and a slider movable along the guide shaft, and a pressure receiving plate provided on one of the guide shaft and the slider to form a cylinder chamber between the outer surface of the guide shaft and the internal surface of the slider and to define the cylinder chamber into two pressure chambers arranged side by side in the slider moving direction. The gas pressure actuator is constructed in a manner such that a compressed gas is introduced into or discharged from the two respective pressure chambers by way of servo valves, so as to use a pressure difference between the two pressure chambers to drive the slider. Further, the gas pressure actuator includes a position sensor for detecting the position of the slider, two servo amplifiers for controlling the servo valves, and a controlling and computing device for receiving a position detection signal fed from the position sensor and for producing position instruction values to the two servo amplifiers.

According to an aspect of the present invention, the method comprises the steps of: performing a computation on each of the position instruction values to be fed to the two servo amplifiers, so as to compensate for a pressure change which has occurred in each of the pressure chambers due to a change in the position of the pressure receiving plate in the cylinder chamber; and producing position instruction values to the two servo amplifiers.

A gas pressure actuator according to the present invention is characterized by incorporating an improved controlling and computing device which performs the following steps. Namely, the controlling and computing device performs the steps of: differentiating a slider position represented by a detected position signal, and calculating the velocity of the slider, meanwhile differentiating the calculated velocity so as to calculate an acceleration; using a slider target position, said slider position, said velocity and said acceleration to calculate position instruction values to be fed to the two servo amplifiers; performing a computation on the respectively calculated position instruction values, so as to compensate for a pressure change which has occurred in each of the pressure chambers due to a change in the position of the pressure receiving plate in the cylinder chamber; and producing the respectively compensated position instruction values to the two servo amplifiers.

DESCRIPTION OF THE PREFERRED EMBODIMENTS

Figure 1:
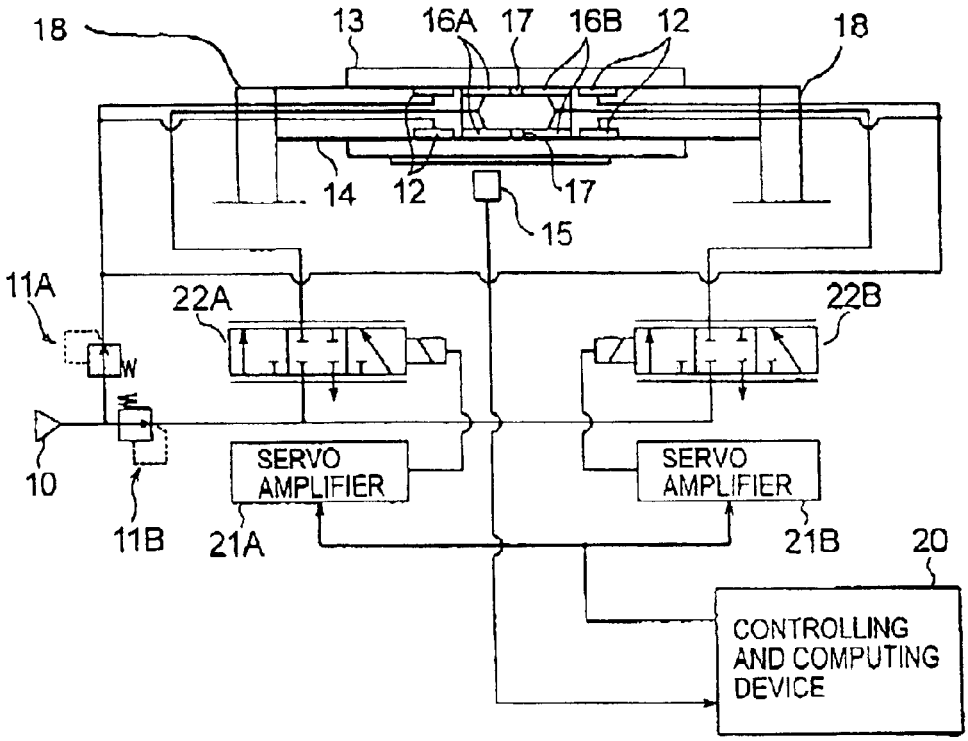
FIG.1 RELATED ART
FIG. 1 is an explanatory view showing the constitution of an air pressure actuator previously suggested by the inventors of the present invention.
Figure 2:
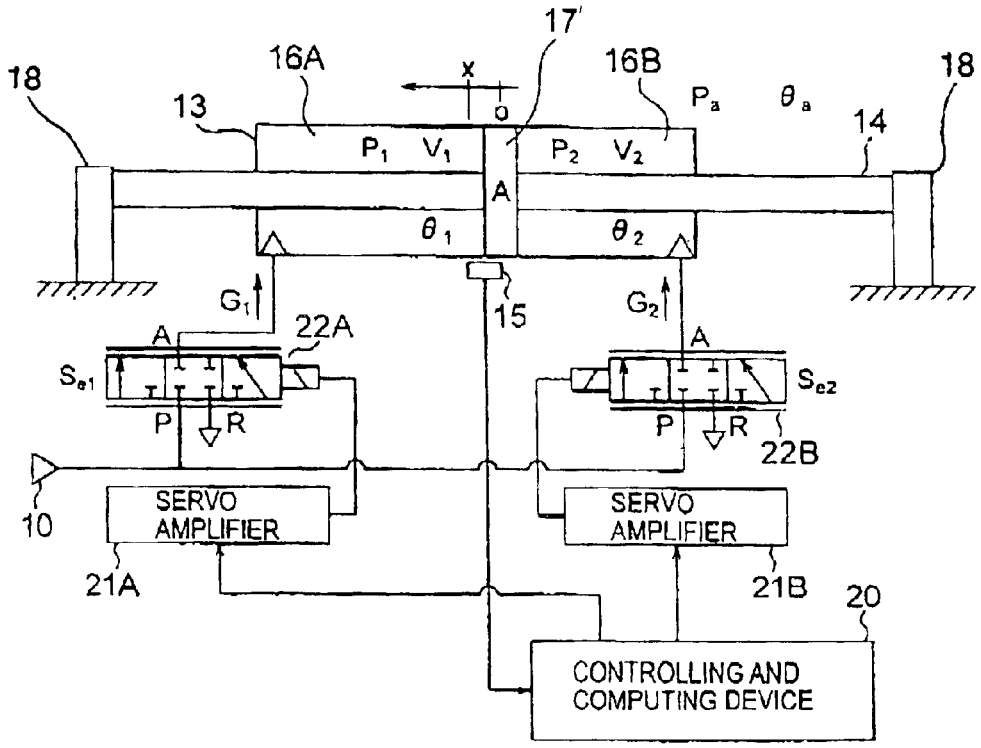
FIG. 2 is an explanatory view schematically showing the constitution of an improved air pressure actuator according to the present invention.

In the following, with reference to FIG. 2, description will be given to explain an air pressure actuator according to one embodiment of the present invention. FIG. 2 is a view formed by simplifying an air pressure actuator shown in FIG. 1, so that elements or members which are the same as those shown In FIG. 1 are represented by the same reference numerals. Although in the present embodiment, a pressure receiving plate 17' is fixed on the guide shaft 14, its operational principle is the same as the above-discussed actuator previously suggested by the inventors of the present invention. Here, when an entire internal space of the slider 13 is used as one cylinder space, a pressure difference between the pressure chambers 16A and 16B can cause the slider 13 to move in one of the two directions, so as to cause a change in the position of the pressure receiving plate 17' within the slider 13. This means that the air pressure actuator of the present invention can be applied to any optional condition in which the pressure receiving plate is fixed on either the guide shaft 14 or the slider 13. Further, although the static pressure air bearings supporting the slider 13 without touching it are not shown in the drawing, the slider 13 is supported by the static pressure air bearings without touching in the same manner as shown in FIG. 1.

The symbols used in the following are a pressure P, a volume V, a temperature θ, a gas constant R, a pressure receiving area A, with a suffix 1 attached to each of the parameters representing the conditions in an area belong or close to the pressure chamber 16A, and with a suffix 2 attached to each of the parameters representing the conditions in an area belong or close to the pressure chamber 16B.

In various equations listed in the following, one symbol with one dot (.) on it represents a time differentiation of only once, while one symbol with two dots (..) on it represents a time differentiation of twice. On the other hand, a symbol with a bar (-) on it is used to represent an average value.

As describe above, the air pressure actuator employs two servo valves 22A and 22B, two servo amplifiers 21A and 21B, as well as a controlling and computing device 20, so as to control the flow rate of a compressed air flowing to the pressure chambers 16A and 16B, thereby driving the slider 13 by virtue of a pressure difference existing between the two pressure chambers 16A and 16B.

When a state change of a gas within the pressure chambers is assumed to be an adiabatic change (adiabatic coefficient k), such a state change can be represented by the following equation (1).

$$\dot{P}_1 = -\frac{\kappa A P_1}{V_1}\dot{x} + \frac{\kappa R \theta_1}{V_1} G_1 \tag{1}$$

In the above equation (1), $G_1$ represents a mass flow rate of a gas supplied from the servo valve 22A.

Since the state equation (1) is non-linear, once the volumes of the pressure chambers are changed, some related characteristics will also change correspondingly.

If a state (pressure: "$\overline{P}$"; volume: "$\overline{V}$"; temperature: "$\overline{\theta}$") in which the slider 13 is stopped (with the pressure receiving plate 17 positioned in the vicinity of the center of the slider 13) is used as a standard state, the above equation can be represented by the following equation (2).

$$\dot{P}_1 = -\frac{\kappa A \overline{P}}{\overline{V}}\dot{x} + \frac{\kappa R \overline{\theta}}{\overline{V}} G_1 \tag{2}$$

At this time, a temperature change is assumed to be extremely small and $\theta_1$="$\overline{\theta}$" is assumed. In fact, the above equation (2) is established with the center of the slider 13 serving as a standard state, and with the volume being "$\overline{V}$"=constant, so that there is no characteristic change.

Then, an input $G_1$ of the above equation (1) is assumed to be $G_1$' so as to form the flowing equation (3), and It is allowed to consider an input such as that shown in the following equation (4).

$$\dot{P}_1 = -\frac{\kappa A P_1}{V_1}\dot{x} + \frac{\kappa R \theta_1}{V_1} G_1' \tag{3}$$

$$G_1' = \frac{A V_1}{R \theta_1}\left(-\frac{\overline{P}}{\overline{V}} + \frac{P_1}{V_1}\right)\dot{x} + \frac{V_1 \overline{\theta}}{\overline{V} \theta_1} G_1 \tag{4}$$

If we substitute the above equation (4) for a corresponding factor in the above equation (3), a non-linear equation which is the above equation (1) will become equal to the above equation (2) which is a linear equation.

Further, an equation formed by linearizing a flow rate equation of a fluid passing through the servo valve 22A (at this time, the servo valve 22A is assumed to be in an intake state, while the servo valve 22B is assumed to be in an exhaust state) can be represented by the following equation (5).

$$G_1 = K_f K_{se} \delta \frac{\overline{P}}{\sqrt{R\overline{\theta}}} u_1 \tag{5}$$

Here, $K_f$ and $\delta$ are coefficients depending upon the shapes of the servo valves and an air supply pressure, $K_{se}$ is a gain of a servo valve opening degree and an Instruction to be fed to a servo amplifier, $u_1$ is a position instruction value to be fed to the servo amplifier 21A.

In the above equation (5), if a new input to the servo amplifier 21A is assumed to be $u_1'$, and if the following equation (6) is established based on the above equation (4) and the above equation (5), $$u_1' = \frac{AV_1\sqrt{R\overline{\theta}}}{K_f K_{se}\delta\overline{P}R\theta_1}\left(-\frac{\overline{P}}{\overline{V}} + \frac{P_1}{V_1}\right)\dot{x} + \frac{V_1\overline{\theta}}{\overline{V}\theta_1}u_1 \tag{6}$$

It is possible to convert a compensation (an equation of a mass flow rate) of the above equation (4) into an equation of an instruction value to be fed to the servo amplifier 21A. Since this equation is established using as an input or an output an instruction fed from the controlling and computing device 20 to the servo amplifier 21A, the computing of the above equation (6) is performed by the controlling and computing device 20, thereby producing a new input $u_1'$ to the servo amplifier 21A.

As to the pressure chamber 16B, since it is assumed that the servo valve 22B is used on the exhaust side, a flow rate equation of a fluid passing through the servo valve 22B can be represented by the following equation (7).

$$G_2 = K_f K_{se} \frac{\overline{P}}{\sqrt{R\overline{\theta}}} u_2 \tag{7}$$

Similarly, as to the pressure chamber 16B, if an equation corresponding to the above equation (6) is deduced, it is possible to obtain the following equation (8).

$$u_2' = \frac{AV_2\sqrt{R\overline{\theta}}}{K_f K_{se}\overline{P}R\theta_2}\left(\frac{\overline{P}}{\overline{V}} - \frac{P_2}{V_2}\right)\dot{x} + \frac{V_2\overline{\theta}}{\overline{V}\theta_2}u_2 \tag{8}$$

If a compensation such as the above equations (6) and (8) is incorporated into the controlling and computing performed in the controlling and computing device 20, it is possible to eliminate a dynamic characteristic change caused by a change in the position of the slider 13, i.e. the position of the pressure receiving plate 17' within the slider 13, thereby enabling the dynamic characteristic to be coincident with a characteristic of a condition in which the pressure receiving plate is in the center of the slider 13, irrespective of the position of the pressure receiving plate 17' within the slider 13.

Next, description will be given to explain an operation of the controlling and computing device 20, in accordance with the following predetermined procedure.

(a) The position of the slider 13 is detected by the position sensor 15, thereby obtaining an electric signal representing a position information. The detected position signal fed from the position sensor 15 is then inputted to the controlling and computing device 20, so that the controlling and computing device 20 starts to perform the following computations (b) to (f).

(b) A slider position x fed from the position censor 15 is differentiated so as to calculate a velocity "$\dot{x}$", and is further differentiated so as to calculate an acceleration "$\ddot{x}$".

(c) Using a slider target position $X_{ref}$, a slider position x, a velocity "$\dot{x}$" and an acceleration "$\ddot{x}$" a position instructing value u is calculated in accordance with the following equation (9).

$$u = K_p(x_{ref} - x) - K_v\dot{x} - K_a\ddot{x} \tag{9}$$

In the above equation, $K_p$, $K_v$ and $K_a$ are respectively a proportional gain, a velocity gain and an acceleration gain.

(d) Position instruction values $u_1$ and $u_2$ to be fed to the servo amplifiers 21A and 21B are calculated in the following manners.

$$u_1 = u$$

$$u_2 = -u$$

(e) A new position instruction value $u_1$ to be fed to the servo amplifier 21A is calculated by using the above equation (6) and in accordance with the following equation (10).

$$u_1' = \frac{AV_1}{K_f K_{se}\delta\overline{P}\sqrt{R\theta_a}}\left(-\frac{\overline{P}}{\overline{V}} + \frac{\overline{P}}{V_1}\right)\dot{x} + \frac{V_1}{\overline{V}}u_1 \tag{10}$$

Here, a pressure $P_1$ in the above equation (6) is assumed to be an equilibrium pressure "$\overline{P}$"(measured in advance) when the slider is stopped, while a temperature $\theta_1$ is assumed to be an equilibrium temperature "$\overline{\theta}$"=an atmospheric temperature $\theta_a$. Further, A position instruction value $u_2'$ to be fed to the servo amplifier 21B is calculated by using the above equation (8) and in accordance with the following equation (11).

$$u_2' = \frac{AV_2}{K_f K_{se}\overline{P}\sqrt{R\theta_a}}\left(\frac{\overline{P}}{\overline{V}} - \frac{\overline{P}}{V_2}\right)\dot{x} + \frac{V_2}{\overline{V}}u_2 \tag{11}$$

Similarly, a pressure $P_2$ in the above equation (8) is assumed to be an equilibrium pressure "$\overline{P}$" when the silder is stopped, while a temperature $\theta_2$ is assumed to be an equilibrium temperature "$\overline{\theta}$"=an atmospheric temperature $\theta_a$.

However, in the above equations (10) and (11), the servo valve 22A is assumed to be on the air supply side, while the servo valve 22B is assumed to be on the air discharge side.

In the case where the air supply side and the air discharge side are changed to each other, the following equation (12) and the following equation (13) are employed.

$$u_1' = \frac{AV_1}{K_f K_{se}\overline{P}\sqrt{R\theta_a}}\left(-\frac{\overline{P}}{\overline{V}} + \frac{\overline{P}}{V_1}\right)\dot{x} + \frac{V_1}{\overline{V}}u_1 \tag{12}$$

$$u_2' = \frac{AV_2}{K_f K_{se}\delta\overline{P}\sqrt{R\theta_a}}\left(\frac{\overline{P}}{\overline{V}} - \frac{\overline{P}}{V_2}\right)\dot{x} + \frac{V_2}{\overline{V}}u_2 \tag{13}$$

Since $V_1$ and $V_2$ are already known because the cross sectional area within the slider 13 is a constant in the axial direction, the position of the slider 13 can also be made known through calculation.

(f) The position instructing value $u_1'$ is fed to the servo amplifier 21A, while the position instruction value $u_2'$ is fed to the servo amplifier 21B.

(g) Then, the servo amplifiers 21A and 21B operate to control the positions of the spools within the respective servo valves 22A and 22B in accordance with the position instruction values. At this time, a compressed air having an appropriately regulated pressure is supplied to the servo valve 22A as well as to the servo valve 22B, while the flow rate of the compressed air passing therethrough will vary depending upon the positions of the spools within the respective servo valves 22A and 22B.

(h) The compressed air flows which have passed through the servo valves 22A and 22B are then supplied to the two pressure chambers 16A and 16B within the slider 13. Subsequently, a pressure difference between the pressure chambers 16A and 16B will act on the slider 13 so as to drive the slider 13.

(i) The above steps from (a) to (h) are repeated so as to have the slider 13 controlled at a desired position $X_{ref}$.

As can be understood from the above description, the present invention provides an improved double acting air pressure actuator capable of controlling, by virtue of the two servo valves, the two compressed air flows flowing to the two pressure chambers, thereby effectively controlling the position of the slider. Particularly, in order to make an effective stroke longer so as to ensure a stabilized positioning control, the positioning control is a control formed by incorporating into the control process a compensation for a dynamic characteristic change caused by a change in the position of the slider.

In fact, the above equation (6) and the above equation (8) are obtained based on an assumption that the state change of the above air flow is an adiabatic change. However, even if an adiabatic coefficient k is replaced by a politropic index n, it is still possible to obtain the same equations. Therefore, the present invention can also be applied to other types of state change (such as an isothermal change and the like). In the following, description will be given to explain such a situation.

A state equation for each of the pressure chambers can be represented by the following equation (14), based on an assumption that the state change of the air flows is a politropic change.

$$\dot{P}_1 = -\frac{-nAP_1}{V_1}\dot{x} + \frac{nR\theta_1}{V_1}G_1' \tag{14}$$

On the other hand, a state equation of a linearized model can be represented by the following equation (15).

$$\dot{P}_1 = -\frac{-nA\overline{P}}{\overline{V}}\dot{x} + \frac{nR\theta_a}{\overline{V}}G_1 \tag{15}$$

Here, n is a politropic index.

Further, since there is a pressure change based on the servo valve flow rate determined with respect to a linear model equation of the above equation (15), the volume V, the pressure P and the temperature θ will change, causing a difference a between a linear model and a non-linear model. If a flow rate value determined by the linear model is to be made the same as a pressure response based on the non-linear model of the above equation (14), we can use the following equation (16) and the following equation (17).

$$G_1' = \frac{AV_1}{R\theta_1}\left(-\frac{\overline{P}}{\overline{V}} + \frac{P_1}{V_1}\right)\dot{x} + \frac{\theta_a}{\theta_1}\frac{V_1}{\overline{V}}G_1 \tag{16}$$

-continued $$G_2' = -\frac{AV_2}{R\theta_2}\left(-\frac{\overline{P}}{\overline{V}} + \frac{P_2}{V_2}\right)\dot{x} + \frac{\theta_a}{\theta_2}\frac{V_2}{\overline{V}}G_2 \tag{17}$$

Here, a compensation is made only for dealing with an influence caused by a volume change. On the other hand, if a pressure change and a temperature change are neglected, since $P_1=P_2=$"$\overline{P}$", $\theta_1=\theta_2=\theta_a$, it is allowed to obtain the following equation (18) and the following equation (19).

$$G_1' = \frac{A\overline{P}}{R\theta_a}\left(-\frac{V_1}{\overline{V}} + 1\right)\dot{x} + \frac{V_1}{\overline{V}}G_1 \tag{18}$$

$$G_2' = -\frac{A\overline{P}}{R\theta_a}\left(-\frac{V_2}{\overline{V}} + 1\right)\dot{x} + \frac{V_2}{\overline{V}}G_2 \tag{19}$$

Here, $G_1$ and $G_2$ can be represented by the following equation (20) and the following equation (21).

$$G_1 = \frac{K_f\delta S_{e1}\overline{P}}{\sqrt{R\theta_a}} \tag{20}$$

$$G_2 = \frac{K_f S_{e2}\overline{P}}{\sqrt{R\theta_a}} \tag{21}$$

However, $S_{e1}$ and $S_{e2}$ are respectively effective cross sectional areas of the flowing passages passing through the servo valves 22A and 22B, and if they are represented by effective cross sectional areas, it is possible to obtain the following equations (22) and (23).

$$S_{e1}' = \frac{A}{K_f\delta\sqrt{R\theta_a}}\left(-\frac{V_1}{\overline{V}} + 1\right)\dot{x} + \frac{V_1}{\overline{V}}S_{e1} \tag{22}$$

$$S_{e2}' = -\frac{A}{K_f\sqrt{R\theta_a}}\left(-\frac{V_2}{\overline{V}} + 1\right)\dot{x} + \frac{V_2}{\overline{V}}S_{e2} \tag{23}$$

Further, based on the following equations:

$S_{e1}=K_{se}U_1$ $S_{e2}=K_{se}U_2$

If the above parameters are represented by position instruction values (voltages), it is allowed to obtain the following equations (24) and (25).

$$u_1' = \frac{A}{K_f\delta K_{se}\sqrt{R\theta_a}}\left(-\frac{V_1}{\overline{V}} - 1\right)\dot{x} + \frac{V_1}{\overline{V}}u_1 \tag{24}$$

$$u_2' = -\frac{A}{K_f K_{se}\sqrt{R\theta_a}}\left(-\frac{V_2}{\overline{V}} + 1\right)\dot{x} + \frac{V_2}{\overline{V}}u_2 \tag{25}$$

In this way, similar to a situation in which a gas state change is an adiabatic change, it is possible to perform a positioning control which includes a compensation for a dynamic characteristic change caused due to a change in the position of the slider.

Upon making a comparison between the present invention and a conventional actuator, it is easy to understand the following facts. Namely, in a conventional actuator where two servo valves were used to perform a position control of the slider, it was difficult to perform a stabilized control because of a non-linear property of the dynamic characteristic change based on the slider position, hence rendering it difficult to obtain a long and effective stroke with respect to a mechanical stroke of the slider.

In contrast to the above conventional actuator, according to the present invention, with the use of the controlling and computing device described above, it is possible to perform a compensation for a non-linear change of the dynamic characteristics based on the slider position, thereby realizing an enlargement of an effective stroke as well as a stabilized control of the same.

In addition, other gases, such as a nitrogen gas, may be used in place of the air.

What is claimed is:

1. A method for controlling a gas pressure actuator which includes a guide shaft and a slider movable along the guide shaft, and a pressure receiving plate provided on one of the guide shaft and the slider to form a cylinder chamber between the outer surface of the guide shaft and the internal surface of the slider and to define the cylinder chamber into two pressure chambers arranged side by side in the slider moving direction, wherein a compressed gas is introduced into or discharged from the two respective pressure chambers by way of servo valves, so as to use a pressure difference between the two pressure chambers to drive the slider, and wherein the gas pressure actuator further includes a position sensor for detecting the position of the slider, two servo amplifiers for controlling the servo valves, and a controlling and computing device for receiving a position detection signal fed from the position sensor and for producing position instruction values to the two servo amplifiers, characterized in that the method comprises the steps of:

performing a computation on each of the position instruction values to be fed to the two servo amplifiers, so as to compensate for a pressure change which has occurred in each of the pressure chambers due to a change in the position of the pressure receiving plate in the cylinder chamber; and producing the respectively compensated position instruction values to the two servo amplifiers.

2. A gas pressure actuator which includes a guide shaft and a slider movable along the guide shaft, and a pressure receiving plate provided on one of the guide shaft and the slider to form a cylinder chamber between the outer surface of the guide shaft and the internal surface of the slider and to define the cylinder chamber into two pressure chambers arranged side by side in the slider moving direction, wherein a compressed gas is introduced into or discharged from the two respective pressure chambers by way of servo valves, so as to use a pressure difference between the two pressure chambers to drive the slider, and wherein the gas pressure actuator further includes a position sensor for detecting the position of the slider, two servo amplifiers for controlling the servo valves, and a controlling and computing device for receiving a position detection signal fed from the position sensor and for producing position instruction values to the two servo amplifiers, characterized in that the controlling and computing device performs the steps of:

differentiating a slider position represented by a detected position signal, and calculating the velocity of the slider, meanwhile differentiating the calculated velocity so as to calculate an acceleration;

using a slider target position, said slider position, said velocity and said acceleration to calculate position instruction values to be fed to the two servo amplifiers;

performing a computation on the respectively calculated position instruction values, so as to compensate for a pressure change which has occurred in each of the pressure chambers due to a change in the position of the pressure receiving plate in the cylinder chamber; and producing the respectively compensated position instruction values to the two servo amplifiers.

3. A gas pressure actuator according to claim 2, wherein at least one end of the guide shaft is fixed, said slider is a cylinder with the guide shaft passing therethrough, said pressure receiving plate is installed within said slider.

4. A gas pressure actuator according to claim 3, wherein intake/exhaust systems are connected respectively to the two pressure chambers for introducing the compressed gas into or discharging the same from the pressure chambers, said servo valves are connected to the intake/exhaust systems.

5. A gas pressure actuator according to claim 4, wherein gas passages are formed within the guide shaft, extending from both ends of the guide shaft to the pressure chambers, thereby introducing the compressed gas into or discharging the same from the two pressure chambers.

* * * * *